US007614928B2

(12) United States Patent
Grivna

(10) Patent No.: US 7,614,928 B2
(45) Date of Patent: Nov. 10, 2009

(54) SWIM SHOE WITH LATERAL FINS

(76) Inventor: Gerald J. Grivna, 35999 S. 568 Rd., Jay, OK (US) 74346

( * ) Notice: Subject to any disclaimer, the term of this patent is extended or adjusted under 35 U.S.C. 154(b) by 18 days.

(21) Appl. No.: 11/952,197

(22) Filed: Dec. 7, 2007

(65) Prior Publication Data

US 2009/0149093 A1 Jun. 11, 2009

(51) Int. Cl.
*A63B 31/11* (2006.01)
*A63B 31/00* (2006.01)
*A63B 31/06* (2006.01)

(52) U.S. Cl. ..... 441/61; 441/55; 441/60; 441/64

(58) Field of Classification Search ..... 441/61, 441/55, 60–65
See application file for complete search history.

(56) References Cited

U.S. PATENT DOCUMENTS

| | | | | |
|---|---|---|---|---|
| 895,451 | A * | 8/1908 | Gorham | 441/61 |
| 1,983,609 | A * | 12/1934 | Hudson | 441/61 |
| 3,107,372 | A | 10/1963 | Brown et al. | |
| 3,867,734 | A * | 2/1975 | Courageux | 441/64 |
| 4,310,938 | A | 1/1982 | Eichler | |
| 5,102,120 | A | 4/1992 | Lindblad | |
| 5,183,424 | A * | 2/1993 | Field | 441/64 |
| 5,330,377 | A | 7/1994 | Kernek | |
| 5,702,277 | A | 12/1997 | Wagner | |
| 5,795,204 | A | 8/1998 | Bruner | |
| 5,810,629 | A | 9/1998 | Parr | |
| 6,620,008 | B2 | 9/2003 | Green | |
| 6,871,420 | B2 * | 3/2005 | Shikhashvili | 36/8.1 |

FOREIGN PATENT DOCUMENTS

| | | |
|---|---|---|
| FR | 420229 A | 1/1911 |
| WO | 02074395 | 9/2002 |

* cited by examiner

*Primary Examiner*—Lars A Olson
*Assistant Examiner*—Daniel V Venne
(74) *Attorney, Agent, or Firm*—Head, Johnson & Kachigian

(57) ABSTRACT

A swim shoe comprising a foot-covering portion and a pair of lateral fins located on opposing sides of the foot-covering portion, where said lateral fins do not extend beyond the front of the foot-covering portion. The lateral fins may further extend upward from the foot-covering portion and include a bend a particular distance from the foot-covering portion such that the lateral fins extend outward from the foot-covering portion. The swim shoe may additionally comprise a secondary pair of lateral fins located below the first pair. The secondary lateral fins may further extend upward from the foot-covering portion and include a bend a particular distance from the foot-covering portion such that the secondary lateral fins extend outward from the foot-covering portion.

10 Claims, 3 Drawing Sheets

SWIM SHOE WITH LATERAL FINS

REFERENCE TO PENDING APPLICATIONS

This application is not based upon any pending domestic or international patent applications.

REFERENCE TO MICROFICHE APPENDIX

This application is not referenced in any microfiche appendix.

BACKGROUND OF THE INVENTION

1. Field of the Invention

The present invention generally relates to swimming aids. More specifically, the present invention relates to swim shoes and swim fins.

2. Prior Art

In the field of swimming aids, swim fins are well known. A typical swim fin comprises a foot-covering portion and a fin extending longitudinally from and away from the toe of the foot-covering portion. This allows the user to gain more power in their swimming by increasing the surface area over which their foot displaces water while kicking. The main drawback to the typical design is that walking in the typical swim fin is awkward and difficult, and climbing ladders, as those on the sides of boats, is nearly impossible. Additionally, the typical fin is suitable only for a standard flutter kick, and is of no assistance, and could potentially be a hindrance, to other types of kicks such as a frog kick.

Swim shoes are also well known, and typically provide a cover for a user's foot while walking oh a beach or deck and while in the water. There are several versions of swim shoes that integrate fins into their design. However, most sacrifice surface area, and thus effectiveness, for the sake of improving mobility. Additionally, most swim shoes that integrate fins into their design retain the longitudinal extension of the fin beyond the toe of the shoe, and thus only marginally improve the problem with walking and do not address the problem with climbing ladders at all.

Based on the foregoing, there is a need for a swim shoe with integrated fins that does not sacrifice the effectiveness of a typical swim fin but that allows the user to easily walk and climb ladders while wearing the swim shoe and that can be used for all types of swimming kicks.

BRIEF SUMMARY OF THE INVENTION

The present invention is a swim shoe with lateral fins. It is comprised of a foot-covering portion and a pair of lateral fins located on opposing sides of the foot-covering portion. Each fin may extend away from the foot-covering portion at an upward angle, with a bend at a particular distance from the foot-covering portion and a second portion extending from the bend to the edge of the lateral fin, where the bend is such that the second portion extends outward away from the foot-covering portion. The distance from the foot-covering portion to the bend may increase from the front to the back of the foot-covering portion. The swim show may additionally comprise two mechanical stops attached to the foot-covering portion on opposing sides located between the top of the foot covering portion and the lateral fins, such that the stops prevent the lateral fins from bending toward the top of the foot-covering portion further than a particular distance.

The swim shoe may further comprise a second pair of lateral fins located on opposing sides of the foot-covering portion below the first pair of lateral fins. Each of the fins in the second pair may extend away from the foot-covering portion at an upward angle, with a bend at a particular distance from the foot-covering portion and a second portion extending from the bend to the edge of the secondary lateral fin, where the bend is such that the second portion extends outward away from the foot-covering portion. The distance from the foot-covering portion to the bend in the secondary lateral fin may increase from the front to the back of the foot-covering portion. The swim shoe may additionally comprise two mechanical stops attached to the lateral fins and located between the lateral fins and the secondary lateral fins, such that the slops prevent the secondary lateral fins from bending toward the lateral fins further than a particular distance.

The swim shoe may further comprise an ankle strap connected to the foot-covering portion such that the swim shoe remains attached to a user should the foot-covering portion come off of the user's foot during use.

A better understanding of the invention will be obtained from the following detailed description of the preferred embodiment taken in conjunction with the drawings and the attached claims.

DETAILED DESCRIPTION OF THE PREFERRED EMBODIMENT

It is to be understood that the invention that is now to be described is not limited in its application to the details of the construction and arrangement of the parts illustrated in the accompanying drawings. The invention is capable of other embodiments and of being practiced or carried out in a variety of ways. The phraseology and terminology employed herein are for purposes of description and not limitation.

Figure 1:
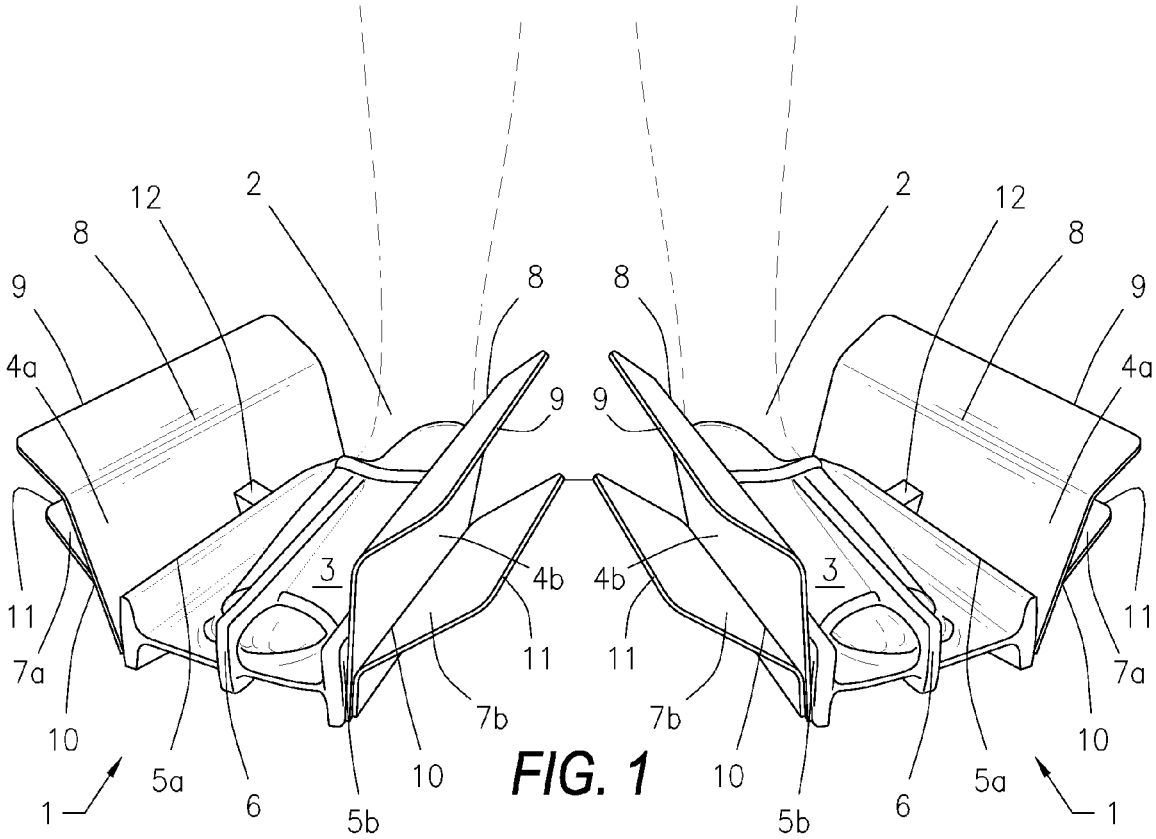
FIG. 1 is a front perspective view of a pair of swim shoes with lateral fins in place on a user's feet.
Figure 2:
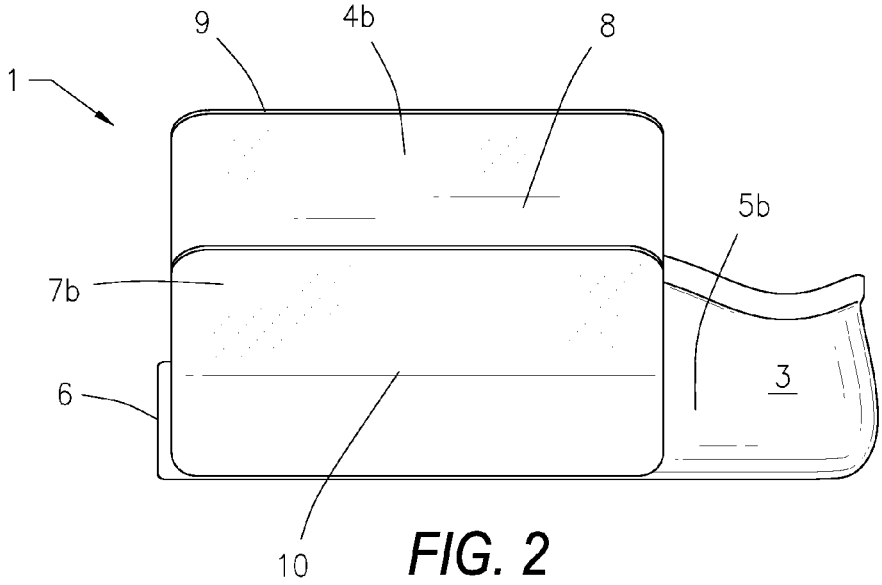
FIG. 2 is a side view of a swim shoe with lateral fins.
Figure 3:
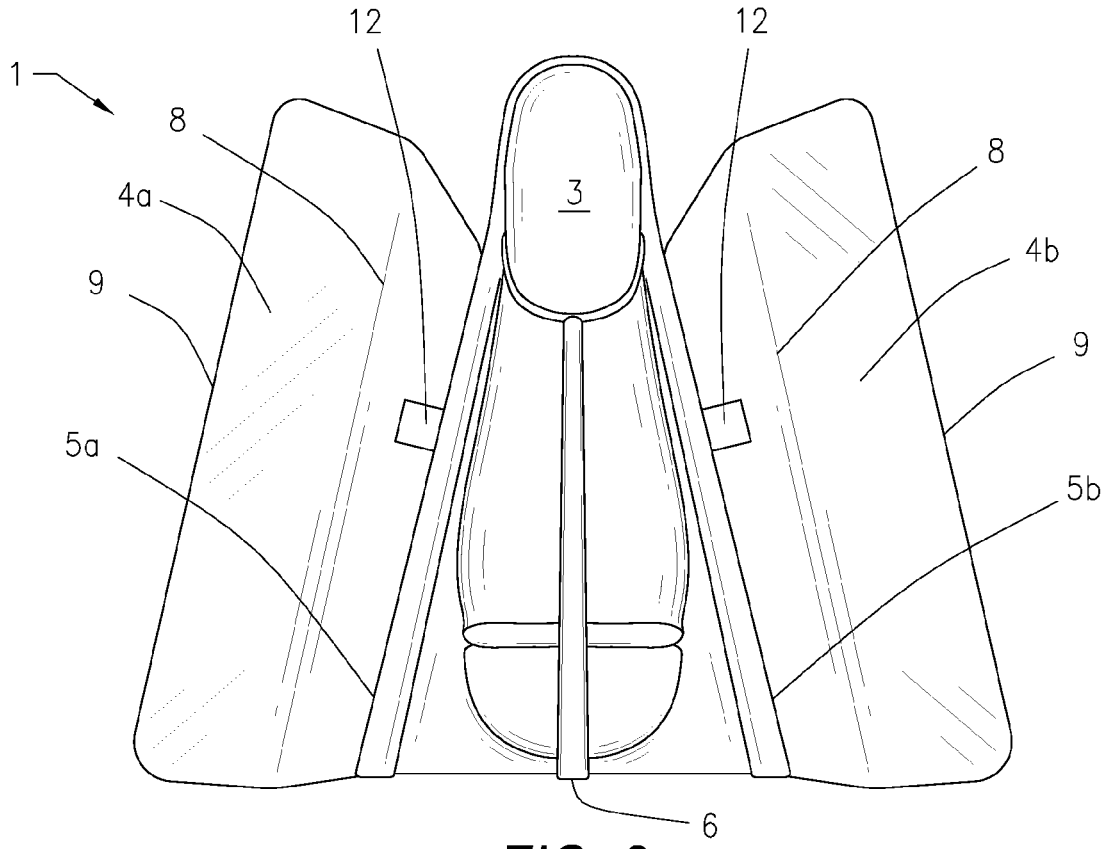
FIG. 3 is a top view of a swim shoe with lateral fins.
Figure 4:
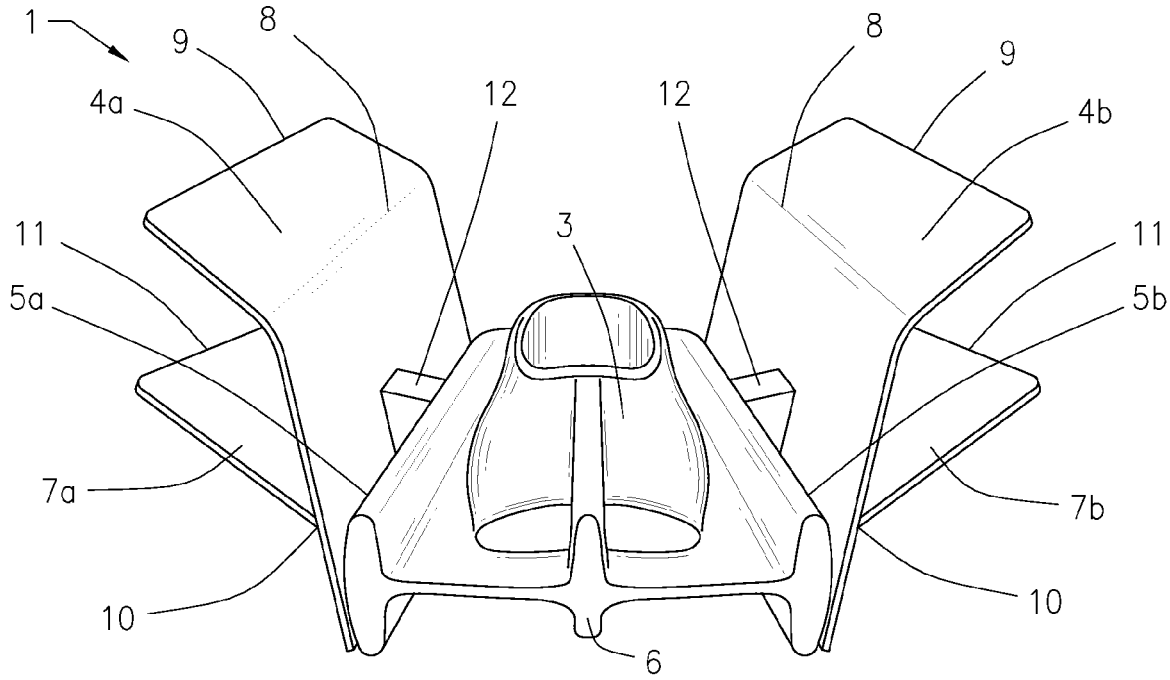
FIG. 4 is a front perspective view of a swim shoe with lateral fins.
Figure 5:
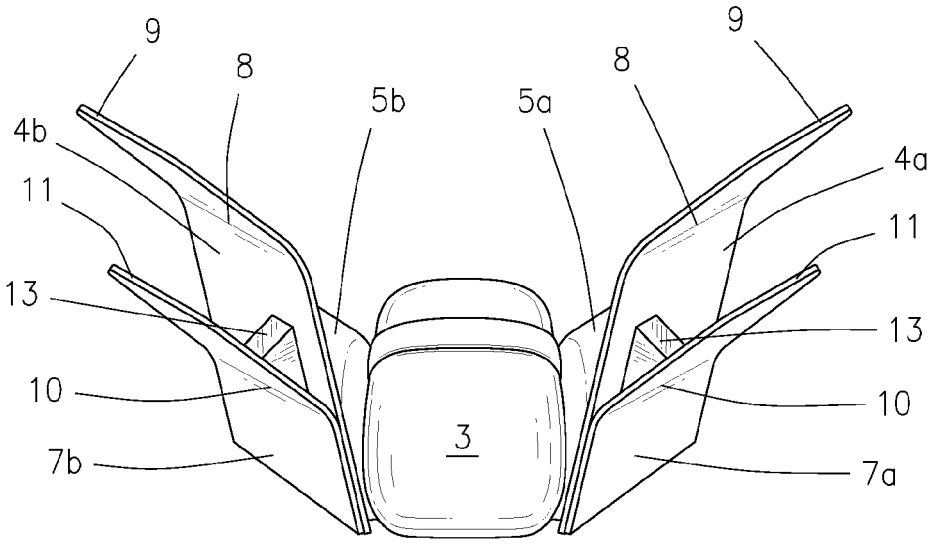
FIG. 5 is a back perspective view of a swim shoe with lateral fins.
Figure 6:
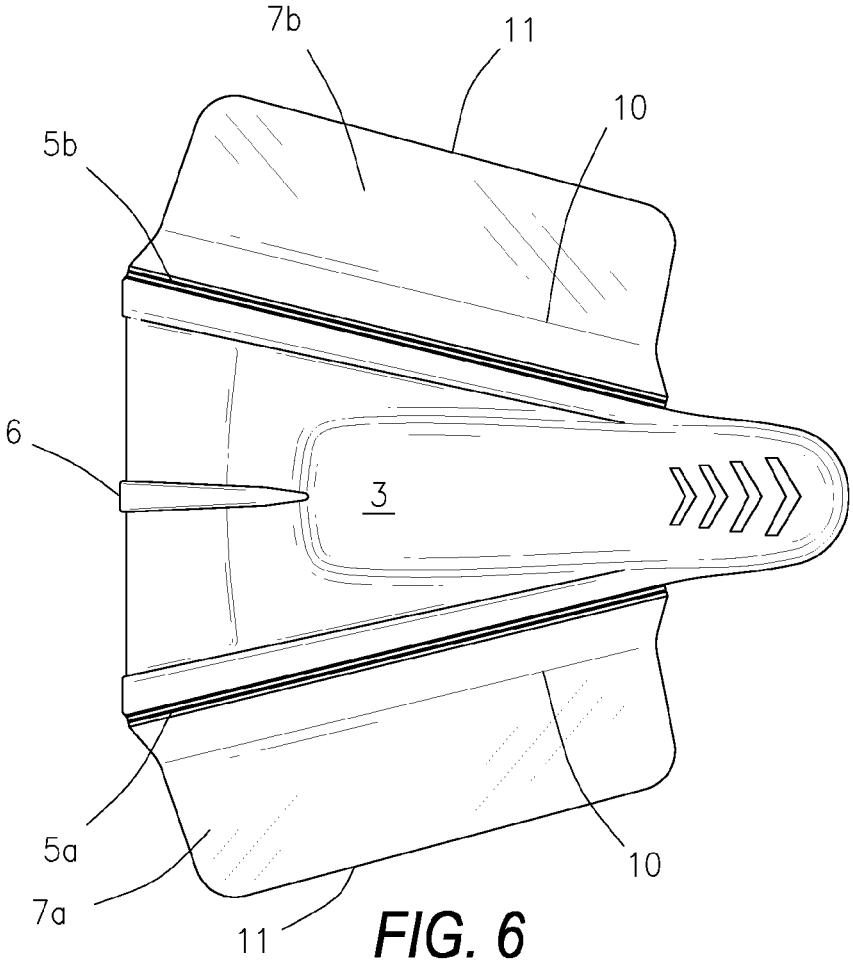
FIG. 6 is a bottom view of a swim shoe with lateral fins.

The swim shoe with lateral fins 1 may be seen in FIGS. 1 through 6. FIG. 1 shows a pair of swim shoes with lateral fins 1 on a user's feet 2, while FIGS. 2 through 6 show a swim shoe with lateral fins 1 from different angles.

The swim shoe with lateral fins 1 is made up of a foot-covering portion 3 and a pair of lateral fins 4*a* and 4*b*, each located on opposing sides 5*a* and 5*b* of said foot-covering portion 3, where said lateral fins do not extend beyond the front 6 of the foot-covering portion 3. The swim shoe with lateral fins may also have a pair of secondary lateral fins 7*a* and 7*b* located below lateral fins 4*a* and 4*b*, respectively. The secondary lateral fins 7*a* and 7*b* may be attached to the lateral fins 4*a* and 4*b*, respectively, or may be attached directly to the foot-covering portion 3.

The lateral fins 4*a* and 4*b* may extend upward and away from the foot-covering portion, and may each have a bend 8 located between the edge of the lateral fin 4 attached to the foot-covering portion 3 and the opposite edge 9 of the lateral fin 4. The bend 8 is such that the portion of the lateral fin 4 between the bend 8 and the opposite edge 9 extends outward away from the foot-covering portion 3 rather than toward the foot-covering portion 3. Likewise, the secondary lateral fins 7*a* and 7*b* may extend upward and away from the foot-covering portion, and may each have a bend 10 located between the edge of the secondary lateral fin 7 attached to the foot-covering portion 3 or lateral fin 4 and the opposite edge 11 of the secondary lateral fin 7. The bend 10 is such that the portion of the secondary lateral fin 7 between the bend 10 and the opposite edge 11 extends outward away from the foot-covering portion 3 and the lateral fin 4, rather than toward the foot-covering portion 3 or the lateral fin 4.

The distance between the foot-covering portion 3 and the bend 8 on each lateral fin 4 may increase from the front 6 of the foot-covering portion 3 to the back of the foot-covering portion 3. Likewise, the distance between the foot-covering portion 3 and the bend 10 on each secondary lateral fin 7 may decrease from the front 6 of the foot-covering portion 3 to the back of the foot-covering portion 3. This improves the effectiveness of the fins while in use by providing for a surface perpendicular to the direction of motion regardless of what direction the user angles his or her kicks.

The swim shoe with lateral fins 1 may have a pair of mechanical stops 12 each located between the foot-covering portion 3 and the lateral fin 4, such that the stops 12 prevent the lateral fins 4*a* and 4*b* from bending toward the foot-covering portion 3 further than a particular distance. Likewise, the swim shoe with lateral fins 1 may have a second pair of mechanical stops 13 each located between the lateral fin 4 and the secondary lateral fin 7, such that the stops 13 prevent the secondary lateral fins 7*a* and 7*b* from bending toward the lateral fins 4*a* and 4*b* further than a particular distance. The swim shoe with lateral fins 1 may have either the mechanical stops 12, as in FIGS. 1, 3, and 4, or the second pair of mechanical stops 13, as in FIG. 5, or it may have both. If it has both, the stops may be aligned.

The foot-covering portion 3 of the swim shoe with lateral fins may have a back covering the user's heel. This back may aid the user in retaining the swim shoe with lateral fins on their foot. This purpose may also be served by an ankle strap attached to the foot-covering portion 3 if the foot-covering portion 3 does not have a back covering the user's heel. Whether the foot-covering portion 3 has a back or not, the swim shoe with lateral fins 1 may have an ankle strap connected to the foot-covering portion 3 such that the swim shoe 1 remains attached to a user 2 should the foot-covering 3 portion come off of the foot of said user 2 during use. The ankle strap may be adjustable.

The swim shoe with lateral fins may be made of any material typically used in the production of swim fins, including rubber, polypropylene, and other flexible materials, particularly those that float, with or without stiffeners.

The lateral fins do not extend beyond the toe of the foot-covering portion. In other words, the swim shoe with lateral fins does not extend substantially past the end of the user's toes. Therefore, the swim shoe with lateral fins does not hinder a user when walking or when climbing ladders. Furthermore, the total surface area of the lateral fins and secondary lateral fins on the swim shoe with lateral fins is at least as much as the surface area of the longitudinal fin on a typical swim fin. During use, the top fins flatten out to allow more surface area to move the water. Therefore, while the design of the swim shoe with lateral fins eliminates the primary drawback of a typical swim fin, it does not sacrifice effectiveness. In fact, the swim shoe with lateral fins may increase efficiency by 25% to 100%, depending on the type of stroke used. Additionally, the unique design of the swim shoe with lateral fins makes it suitable for all types of kicks, including flutter kicks and frog kicks.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. A swim shoe comprising:

a foot-covering portion having a front, a top, and two sides; and a pair of lateral fins, each located on opposing sides of said foot-covering portion, where:

said lateral fins do not extend beyond the front of said foot-covering portion;

each of said lateral fins comprises a first portion extending from said foot-covering portion at an upward angle, a bend located a particular distance from said foot-covering portion, and a second portion extending from said bend to an edge of said lateral fin;

the bend is such that the second portion extends outward away from said foot-covering portion; and the distance from the foot-covering portion to the bend increases from the front of said foot-covering portion to a back of said foot-covering portion.

2. A swim shoe comprising:

a foot-covering portion having a front, a top, and two sides;

a pair of lateral fins, each located on opposing sides of said foot-covering portion, where said lateral fins do not extend beyond the front of said foot-covering portion; and a pair of secondary lateral fins, each located on opposing sides of said foot-covering portion between the bottom of said foot-covering portion and the lateral fin located on the same side of said foot-covering portion, where:

said secondary lateral fins do not extend beyond the front of said foot-covering portion;

each of said secondary lateral fins comprises a first portion extending from said foot-covering portion at an upward angle, a bend located a particular distance from said foot-covering portion, and a second portion extending from said bend to an edge of said secondary lateral fin; and the bend is such that the second portion extends outward away from said foot-covering portion.

3. The swim shoe of claim 2, where each of said lateral fins comprises a first portion extending from said foot-covering portion at an upward angle, a bend located a particular distance from said foot-covering portion, and a second portion extending from said bend to an edge of said lateral fin, where the bend is such that the second portion extends outward away from said foot-covering portion.

4. The swim shoe of claim 3, where the distance from the foot-covering portion to the bend on each of the lateral fins increases from the front of said foot-covering portion to a back of said foot-covering portion and the distance from the foot-covering portion to the first-bend on each of the secondary lateral fins decreases from the front of said foot-covering portion to the back of said foot-covering portion.

5. The swim shoe of claim 2 further comprising two mechanical stops attached to said foot-covering portion on opposing sides, where each stop is located between the top of said foot-covering portion and the lateral fin located on the same side of said foot-covering portion, such that said stops prevent said lateral fins from bending toward the top of said foot-covering portion further than a particular distance, and a second set of two mechanical stops attached to said lateral fins, where each stop is located between the lateral fin and the secondary lateral fin located on the same side of the foot-covering portion, such that said stops prevent said secondary lateral fins from bending toward the lateral fins further than a particular distance.

6. A swim shoe comprising:

a foot-covering portion comprising a sole, the limits of which are defined by the dimensions of a user's foot, a top, and two sides extending upward from said sole, where the foot-covering portion has a front; and a pair of lateral fins, each located on opposing sides of said foot-covering portion, where:

said lateral fins do not extend beyond the front of said foot-covering portion;

each of said lateral fins comprises a first portion extending from said foot-covering portion at an upward angle, a bend located a particular distance from said foot-covering portion, and a second portion extending from said bend to an edge of said lateral fin;

the bend is such that the second portion extends outward away from said foot-covering portion; and the distance from the foot-covering portion to the bend increases from the front of said foot-covering portion to a back of said foot-covering portion.

7. A swim shoe comprising:

a foot-covering portion comprising a sole, the limits of which are defined by the dimensions of a user's foot, a top, and two sides extending upward from said sole, where the foot-covering portion has a front;

a pair of lateral fins, each located on opposing sides of said foot-covering portion, where said lateral fins do not extend beyond the front of said foot-covering portion; and a pair of secondary lateral fins, each located on opposing sides of said foot-covering portion between the bottom of said foot-covering portion and the lateral fin located on the same side of said foot-covering portion, where:

said secondary lateral fins do not extend beyond the front of said foot-covering portion;

each of said secondary lateral fins comprises a first portion extending from said foot-covering portion at an upward angle, a bend located a particular distance from said foot-covering portion, and a second portion extending from said bend to an edge of said secondary lateral fin; and the bend is such that the second portion extends outward away from said foot-covering portion.

8. The swim shoe of claim 7, where each of said lateral fins comprises a first portion extending from said foot-covering portion at an upward angle, a bend located a particular distance from said foot-covering portion, and a second portion extending from said bend to an edge of said lateral fin, where the bend is such that the second portion extends outward away from said foot-covering portion.

9. The swim shoe of claim 8, where the distance from the foot-covering portion to the bend on each of the lateral fins increases from the front of said foot-covering portion to a back of said foot-covering portion and the distance from the foot-covering portion to the first-bend on each of the secondary lateral fins decreases from the front of said foot-covering portion to the back of said foot-covering portion.

10. The swim shoe of claim 7 further comprising two mechanical stops attached to said foot-covering portion on opposing sides, where each stop is located between the top of said fool-covering portion and the lateral tin located on the same side of said foot-covering portion, such that said stops prevent said lateral fins from bending toward the top of said foot-covering portion further than a particular distance, and a second set of two mechanical stops attached to said lateral fins, where each stop is located between the lateral tin and the secondary lateral fin located on the same side of the foot-covering portion, such that said stops prevent said secondary lateral fins from bending toward the lateral fins further than a particular distance.

* * * * *